US006664928B2

(12) United States Patent
Ogawa et al.

(10) Patent No.: US 6,664,928 B2
(45) Date of Patent: Dec. 16, 2003

(54) ANTENNA APPARATUS FOR PERFORMING WIRELESS COMMUNICATION OR BROADCASTING BY SELECTING ONE OF TWO TYPES OF LINEARLY POLARIZED WAVES

(75) Inventors: Takaya Ogawa, Kawasaki (JP); Satoru Inagaki, Yokohama (JP); Yoshiyuki Ikuma, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 10/102,661

(22) Filed: Mar. 22, 2002

(65) Prior Publication Data

US 2003/0052830 A1 Mar. 20, 2003

(30) Foreign Application Priority Data

Aug. 28, 2001 (JP) ..... 2001-258400
Mar. 13, 2002 (JP) ..... 2001-068140

(51) Int. Cl.[7] ..... H01Q 1/38
(52) U.S. Cl. ..... 343/700 MS; 343/872; 343/890

(58) Field of Search ..... 343/700 MS, 702, 343/872, 890, 891, 892

(56) References Cited

U.S. PATENT DOCUMENTS 4,296,355 A * 10/1981 Fukatsu et al. ..... 315/39.51
5,828,339 A * 10/1998 Patel ..... 343/700 MS
6,084,772 A * 7/2000 Pell et al. ..... 361/699
6,373,447 B1 * 4/2002 Rostoker et al. ..... 343/895

FOREIGN PATENT DOCUMENTS

JP 9-63762 3/1997

* cited by examiner

*Primary Examiner*—Tan Ho
(74) *Attorney, Agent, or Firm*—Oblon, Spivak, McClelland, Maier & Neustadt, P.C.

(57) ABSTRACT

An antenna for linearly polarized wave is accommodated in a case in which a heat sink is provided. By rotating the case depending on the vertically polarized wave or the horizontally polarized wave, wireless communication or broadcasting using the vertically polarized wave or the horizontally polarized wave can be selectively realized with high precision.

24 Claims, 6 Drawing Sheets

ANTENNA APPARATUS FOR PERFORMING WIRELESS COMMUNICATION OR BROADCASTING BY SELECTING ONE OF TWO TYPES OF LINEARLY POLARIZED WAVES

CROSS-REFERENCE TO RELATED APPLICATIONS

This application is based upon and claims the benefit of priority from the prior Japanese Patent Applications No. 2001-258400, filed Aug. 28, 2001; and No. 2002-068140, filed Mar. 13, 2002, the entire contents of both of which are incorporated herein by reference.

BACKGROUND OF THE INVENTION

1. Field of the Invention

The present invention relates to an antenna apparatus which is installed, e.g., outdoors and is used for performing wireless transmission of voice or data to a base station connected to a basic network.

2. Description of the Related Art

In recent wireless system, data transmission service referred to as, e.g., WLL (Wireless Local Loop) or FWA (Fixed Wireless Access) is proposed. In such services, an antenna apparatus is installed outdoors, and wireless communication or broadcasting via the antenna apparatus to a base station connected to a basic network is performed.

In such services, a horizontally (H) polarization or a vertically (V) polarization is used depending on types of data to be transmitted, purposes of its use, or environment. An antenna, which is selected depending on whether radio wave used for the communication or broadcasting, is a horizontally polarized wave or a vertically polarized wave, is provided as the antenna apparatus used for the service.

However, in the above-described antenna apparatus, two different types of polarizations must be performed in order to a desired communication network or a broadcasting network. Then, the antenna apparatus which handles the polarized waves used for the desired communication or broadcasting network is selected and installed at a desired location to construct the communication or broadcasting network. Consequently, there arise the problems that the ordering of the antenna apparatus, manufacturing thereof and inventory management thereof are complicated and troublesome.

BRIEF SUMMARY OF THE INVENTION

An object of the present invention is to provide an antenna apparatus which has simple configuration and enables wireless communication or broadcasting using two types of linearly polarized waves in order to simplify handling properties including its order, manufacturing process thereof and inventory management thereof.

The antenna apparatus of the present invention comprises an antenna main body for linearly polarized which is accommodated in a case in a direction of vertically polarized wave or in a direction of horizontally polarized wave, both of directions being perpendicular to each other; and a heat sink which is disposed at a rear surface of the case and thermally coupled to the antenna main body to thermally control the antenna main body.

In accordance with this configuration, the antenna main body is accommodated in a case in a direction of vertically polarized wave or in a direction of horizontally polarized wave. As a result, the present invention can be configured as to as correspond to both of wireless communication or broadcasting using the vertically and wireless communication or broadcasting using the horizontally polarized wave.

It is possible to simply and easily set such that the wireless communication or broadcasting using the vertically polarized wave or the horizontally polarized wave can be performed merely by an operation for changing the direction in which the antenna main body is accommodated in the case. Therefore, simplification of handling properties including order for the antenna apparatus, a manufacturing process thereof and inventory management thereof can be realized and diversification of communication or broadcasting can be accomplished.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Embodiments of the present invention will be described hereinafter with reference to the drawings.

Figure 1:
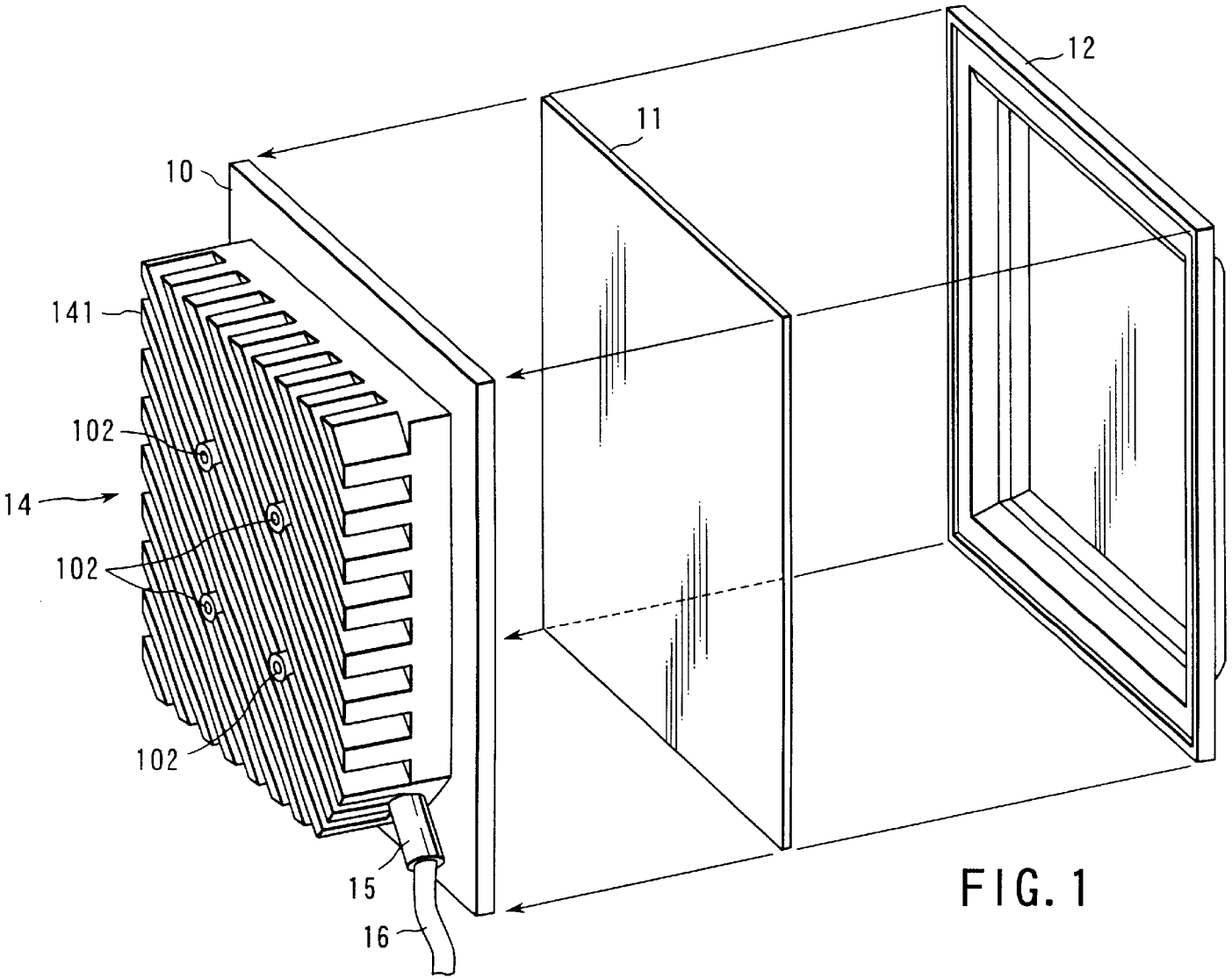
FIG. 1 is an exploded perspective view of an antenna apparatus according to one embodiment of the present invention in which a main portion thereof is exploded and shown.
Figure 2:
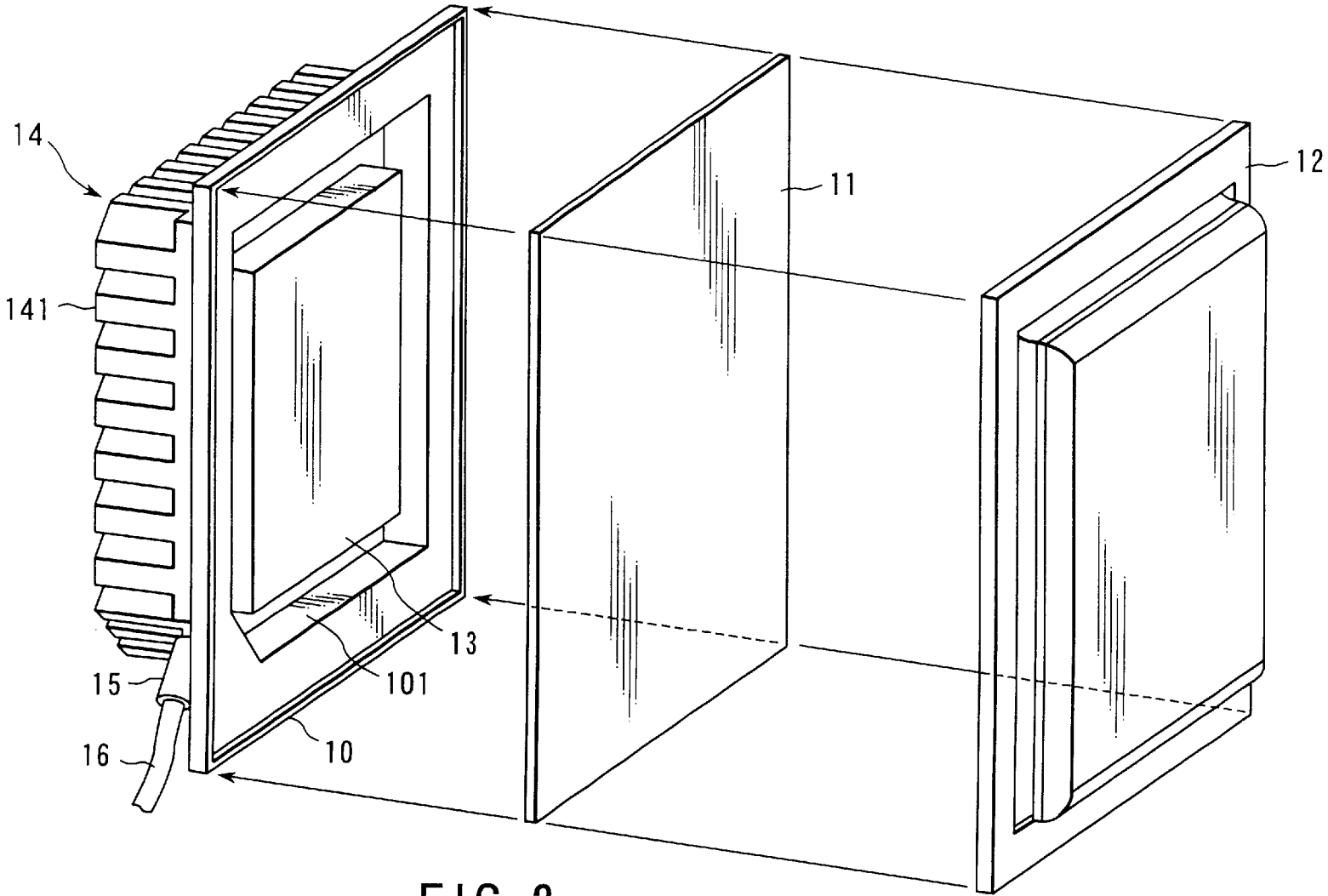
FIG. 2 is an exploded perspective view seen from the front, showing an exploded state shown in FIG. 1.

FIGS. 1 and 2 show respectively an antenna apparatus according to one embodiment of the present invention. FIG. 1 shows a state, as seen from the back, in which a case 10 which configures an antenna main body, an antenna 11 for linearly polarized wave and a radome 12 made of resin material are exploded. FIG. 2 shows such state seen from the front.

The case 10 is made of metallic material such as aluminum or the like and has a substantially concave accommodating portion 101 provided at its one surface. A high-frequency circuit portion 13 is accommodated in the accommodating portion 101 of the case 10. The antenna 11 is placed on the high-frequency circuit portion 13. The radome 12 is attached to a front surface of the high-frequency circuit portion 13 so as to cover the antenna 11. Thus, the high-frequency circuit portion 13 and the antenna 11 are hermetically accommodated within the case 10 and the radome 12.

Figure 3:
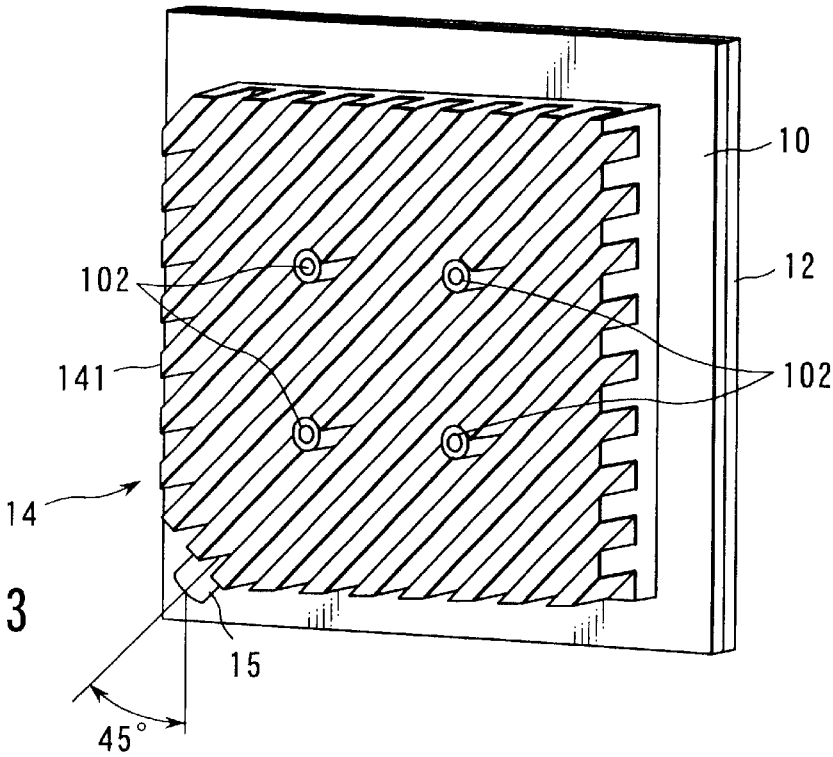
FIG. 3 is a perspective view showing a state in which radiating fins of a heat sink shown in FIG. 1 are arranged in a direction of vertically polarized wave.
Figure 4:
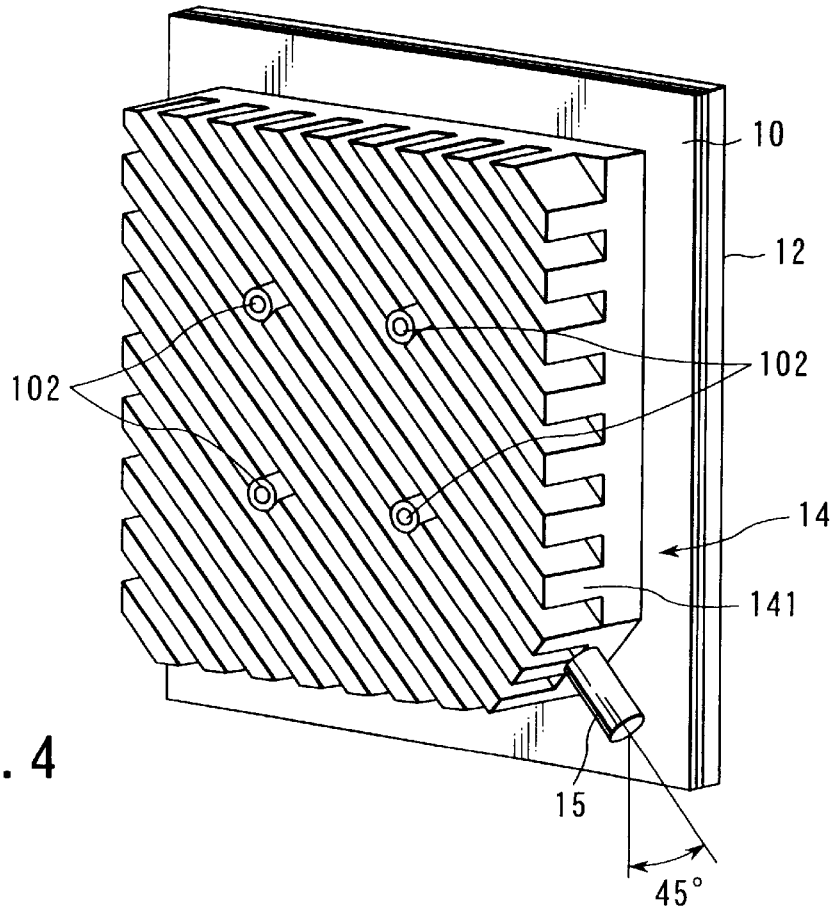
FIG. 4 is a perspective view showing a state in which the radiating fins of the heat sink shown in FIG. 1 are arranged in a direction of horizontally polarized wave.

As shown in FIG. 3, the antenna 11 which is hermetically accommodated within the case 10 and the radome 12 is set so as to be possible to perform communication or broadcasting using vertically (V) polarization in a state in which a plane of polarization governed by the antenna is vertical to the ground. When the case 10 is rotated about 90° from the position of the vertically polarized wave, the plane of polarization governed by the antenna 11 is, as shown in FIG. 4, switched such that wireless communication or broadcasting using a horizontally (H) polarization can be performed.

A radiating heat sink 14 is disposed at the rear surface of the case 10. The heat sink 14 is disposed so as to form a predetermined tilt angle such that radiating fins 141 are disposed so as to form an acute angle of about 45° with respect to, e.g., a direction of gravity in any one of the state of the vertically polarized wave and the state of the horizontally polarized wave. The heat sink 14 is thermally coupled via the case 10 to the high-frequency circuit portion 13 within the accommodating portion 101 of the case 10. Thus, even if the case 10 is rotated 90° such that the antenna 11 is set to either of the direction of the vertically polarized wave and the direction of the horizontal polarized wave, the heat sink 14 takes two substantially symmetrical positions where radiating fins 141 are tilted about 45° with respect to the direction of gravity, while being thermally coupled to the high-frequency circuit portion 13.

When heat is transmitted from the high-frequency circuit portion 13 to the heat sink 14 in the above-described two positions, the heat sink 14 irradiates heat by a chimney effect. Namely, in the chimney effect, air is thermally expanded between the radiating fins 141 such that a specific weight of the air becomes light and updraft occurs. A thermal conductivity of the radiating fins 141 is increased by an effect of flow rate of the updraft. The heat generated at the high-frequency circuit portion 13 is subjected to a so-called natural air cooling by the radiation such that the high-frequency circuit portion 13 is thermally controlled so as to have a predetermined temperature.

An external connector 15 which has, for example, water proofing property and is electrically connected to the high-frequency circuit portion 13 is provided at the rear surface of the case 10 so as to protrude in a direction in which the radiating fins 141 of the heat sink 14 are arranged. An exterior data modulator/demodulator (not shown) which is disposed, for example, indoors is electrically connected via a cable 16 to the external connector 15. The external connector 15 enables electric connection of the external data modulator/demodulator (not shown) with the high-frequency circuit portion 13 within the case 10.

Figure 5:
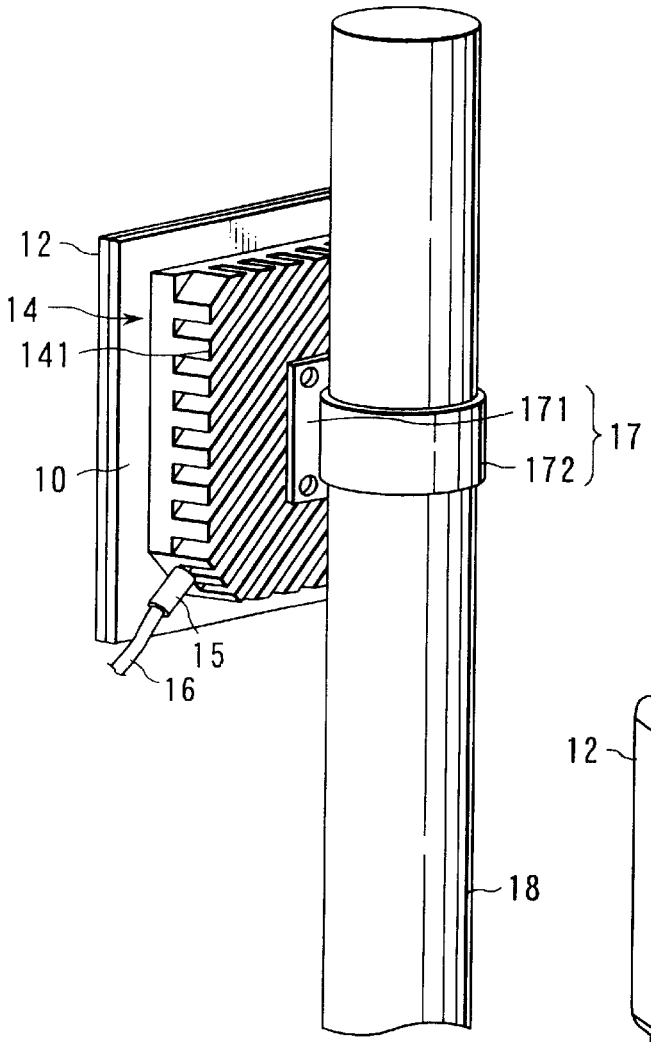
FIG. 5 is a perspective view seen from the back, showing a state in which a case shown in FIG. 1 is mounted to a support.
Figure 6:
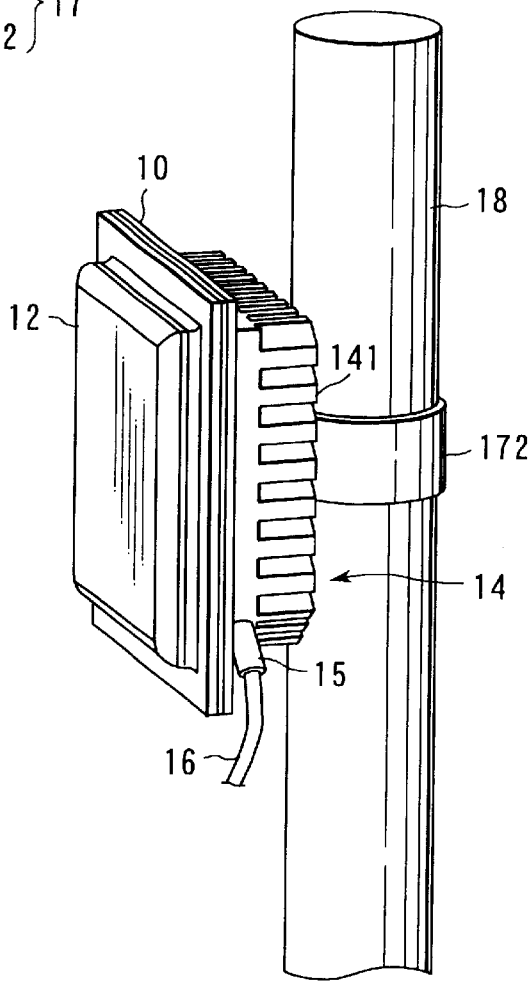
FIG. 6 is a perspective view seen from the front, showing the state in which the case shown in FIG. 1 is mounted to the support.

A plurality of mounting protrusions 102 is provided at the rear surface of the case 10 at predetermined intervals therebetween. As shown in FIGS. 5 and 6, a mounting portion 171 of a mounting band 17 is detachably mounted to these mounting protrusions 102 by using unillustrated screw members or the like. The mounting band 17 is mounted to the mounting protrusions 102 of the case 10 by using the above-mentioned screw members (not shown) in any one of the two positions where the mounting portion 171 is rotated 90° depending on whether the polarized wave governed by the antenna 11 is a vertically polarized wave or a horizontally polarized wave.

The mounting band 17 is mounted by a band portion 172 being wound around a support 18 for installation in a state in which the mounting portion 171 is mounted to the mounting protrusions 102 of the case 10. Thus, the antenna 11 is installed at a desired position where communication or broadcasting is possible with the place of polarization being faced in a direction of vertically polarized wave or a direction of horizontally polarized wave. When the antenna 11 is mounted to the support 18, the position of the mounting band 17 is adjusted such that orientation of the antenna 11 coincides a desired direction of communication or broadcasting.

In the above-described configuration, when a radio wave used for communication or broadcasting is a vertically polarized wave, the mounting portion 171 of the mounting band 17 is mounted to the mounting protrusions 102 of the case 10 and the band portion 172 is mounted to the support 18 by taking a plane of polarization governed by the antenna 11 into consideration. At this time, the orientation of the antenna 11 within the case 10 is adjusted for a desired direction of communication or broadcasting. Here, the external connector 15 is protruded downward so as to form a tilt angle of about 45° with respect to the case 10. The external data modulator/demodulator (not shown) is electrically connected via the cable 16 to the external connector 15.

The antenna 11 receives the vertically polarized and outputs it to the high-frequency circuit portion 13. The high-frequency circuit portion 13 processes inputted high-frequency signal and directs the resulting signal via the external connector 15 and the cable 16 to the external data modulator/demodulator (not shown). Then, the high-frequency signal sent from the external data modulator/demodulator (not shown) is supplied via the cable 16 and the external connector 15 to the high-frequency circuit portion 13. At the high-frequency circuit portion 13 the signal is processed, and then is outputted to the antenna 11 which governs the vertically polarized wave. The resulting signal is sent by the antenna 11 in a desired orientation such that communication or broadcasting is performed.

In the position where communication or broadcasting using the vertically polarized wave is performed, the heat sink 14 within the case 10 is set such that radiating fins 141 are arranged so as to form a tilt angle of about 45° with respect to the direction of gravity and a desired chimney effect is obtained. Thus, the heat sink 14 performs thermal control by effectively and naturally cooling heat quantity generated by drive of high-frequency circuit portion 13.

When switching to a state in which communication or broadcasting using the horizontally polarized wave is possible is performed, the position for mounting the mounting portion 171 of the mounting band 17 to the mounting protrusions 102 of the case 10 is rotated about 90° and the band portion 172 is mounted to the support 18 such that the position of the mounting band 17 is adjusted so as to coincide the direction of communication or broadcasting. Consequently, the antenna 11 is set so as to be possible to perform transmission/receiving of the horizontally polarized wave.

The external connector 15 of the case 10 is protruded downward at the position (where a tilt angle of about 45° is formed) which is rotated about 90° from the position where the communication or broadcasting using the vertically polarized wave is performed. The external data modulator/demodulator is electrically connected via the cable 16 to the external connector 15.

The antenna 11 receives a horizontally polarized wave and outputs it to the high-frequency circuit portion 13. The high-frequency circuit portion 13 processes inputted high-frequency signal and directs the resulting signal via the external connector 15 and the cable 16 to the external data modulator/demodulator (not shown). The high-frequency signal sent from the external data modulator/demodulator (not shown) is supplied via the cable 16 and the external connector 15 to the high-frequency circuit portion 13. Subsequent to the signal being processed at the high-frequency circuit portion 13, the resulting signal is outputted to the antenna 11 which governs the horizontally polarized wave. Then, the signal is sent by the antenna 11 in a desired orientation such that communication or broadcasting is performed.

In the position where the communication or broadcasting using the horizontally polarized wave is performed, the heat sink 14 within the case 10 is set such that the radiating fins 141 are arranged so as to form a tilt angle of about 45° at the position which is rotated about 90° from the position in which the communication or broadcasting using the vertically polarized wave is performed and a desired chimney effect is obtained. Thus, the heat sink 14 exhibits the same chimney effect as in the state of performing the above-described communication or broadcasting using the vertically polarized wave, and performs thermal control by effectively and naturally cooling heat quantity generated by drive of the high-frequency circuit portion 13.

As described above, the antenna apparatus accommodates the antenna 11 for linearly polarized wave together with the high-frequency circuit portion 13 within the case 10 in which the heat sink 14 is provided. By rotating the case 10 90° depending on whether the vertically polarized wave is used or the horizontally polarized wave is used, communication or broadcasting using the vertically polarized wave or the horizontally polarized wave is realized with high precision.

It is possible to simply and easily set such that the communication or broadcasting using the vertically polarized wave or the horizontally polarized wave can be performed merely by changing the direction in which the same case 10 is installed to the support 18. Therefore, simplification of handling properties including order for the antenna apparatus, a manufacturing process thereof and inventory management thereof can be realized and diversification of communication or broadcasting can be accomplished.

The heat sink 14 is disposed at the case 10 such that the radiating fins 141 are tilted so as to form an acute angle with respect to the direction of gravity in both a case of using the vertically polarized wave as a wave governed by the antenna 11 and a case of using the horizontally polarized wave as a wave governed by the antenna 11.

The heat sink 14 can exhibit substantially same chimney effect in both of the position of the vertically polarized wave governed by the antenna 11 and the position of the horizontally polarized wave governed by the antenna 11. Thus, thermal control of the high-frequency circuit portion 13 can be realized with high efficiency.

In the above-described embodiment, a case where the radiating fins 141 of the heat sink 14 are arranged at the rear surface of the case 10 so as to form a tilt angle of about 45° with respect to the direction of gravity in both cases of using the vertically polarized wave governed by the antenna 11 and of using the horizontally polarized wave governed by the antenna 11 has been described. However, the present invention is not limited to this angle at which the fins are arranged, and fins may be arranged at other acute angle and the substantially same effect can be expected.

Figure 7:
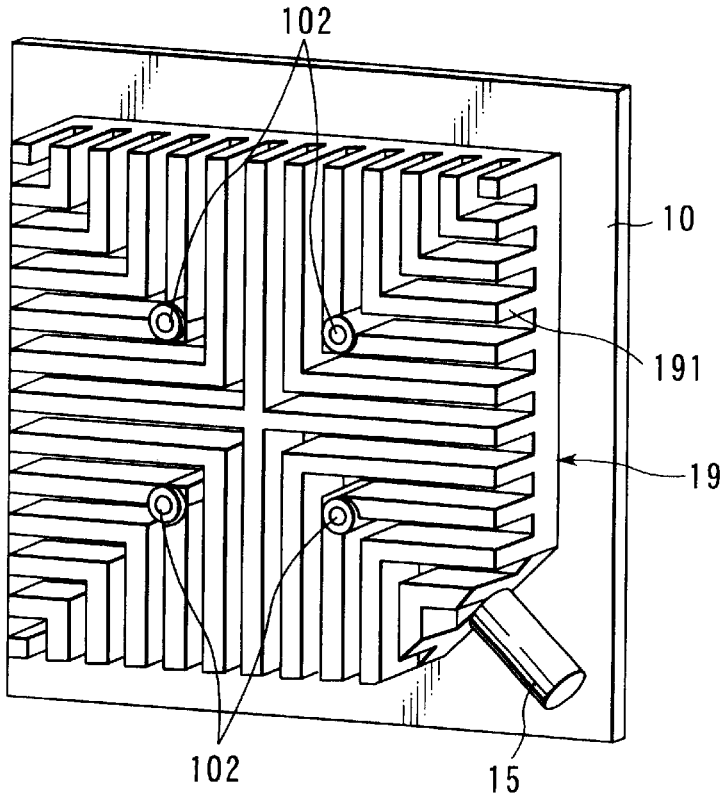
FIG. 7 is a perspective view showing configuration of a heat sink of an antenna apparatus according to another embodiment of the present invention.
Figure 8:
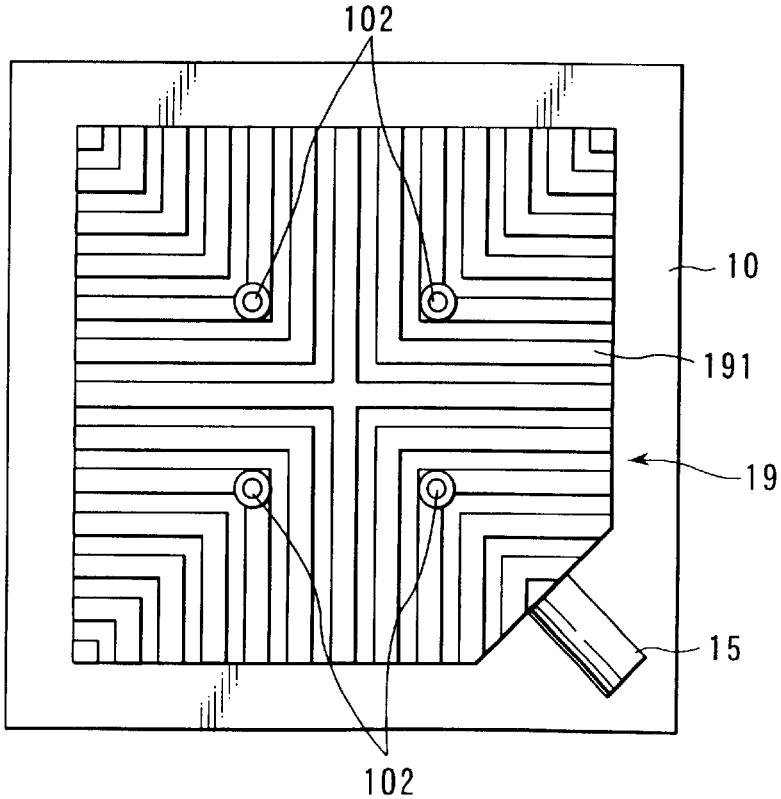
FIG. 8 is a plan view, as seen from the back, of the configuration shown in FIG. 7.
Figure 9:
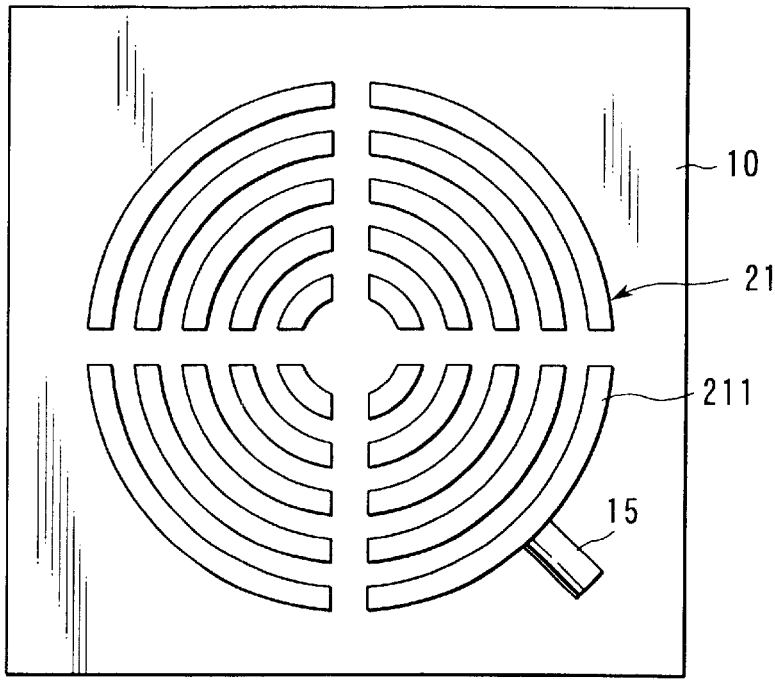
FIG. 9 is a plan view of configuration of a heat sink of an antenna apparatus according to yet another embodiment of the present invention.

In the above embodiment, the case in which the antenna apparatus is configured by using the heat sink 14 in which the radiating fins 141 are arranged so as to form an acute angle with respect to the direction of gravity has been described. However, the present invention is not limited to this case, and configurations such as those shown in FIGS. 7, 8 and 9 may be utilized. In FIGS. 7 through 9, for convenience, the same portions as those of FIGS. 1 through 6 are denoted by the same reference numerals and descriptions thereof are omitted.

A heat sink 19 shown in FIGS. 7 and 8 is formed such that a plurality of radiating fins 191 which are bent about 90° are radially combined and arranged in two directions which are perpendicular to each other. The heat sink 19 is disposed at the rear surface of the case 10. Radiation configuration which effectively utilizes a radiation efficiency of radiating fins 191 depending on the direction that the antenna 11 is arranged is configured. Thus, substantially same radiation efficiency as those of the above-described embodiments can be ensured in both of the case of the vertically polarized wave and the case of the horizontally polarized wave. As a result, substantially same effect as those of the above-described embodiments can be expected.

A heat sink 21 shown in FIG. 9 is configured such that a plurality of curved radiating fins 211 are concentrically arranged. The heat sink 21 is disposed at the rear surface of the case 10. In the heat sink 21, radiation configuration which effectively utilizes a radiation efficiency of the radiating fins 211 depending on the direction that the antenna 11 is arranged is configured. Substantially same radiation efficiency as those of the above-described embodiments can be ensured in both of the case of the vertically polarized wave and the case of the horizontally polarized wave. As a result, substantially same effect as those of the above-described embodiments can be expected.

In the above-described embodiments, the configuration in which the radiating fins 211 of the heat sink 21 are concentrically arranged is shown. However, the present invention is not limited to this configuration, and the radiating fins 211 may be arranged substantially circularly.

Figure 10:
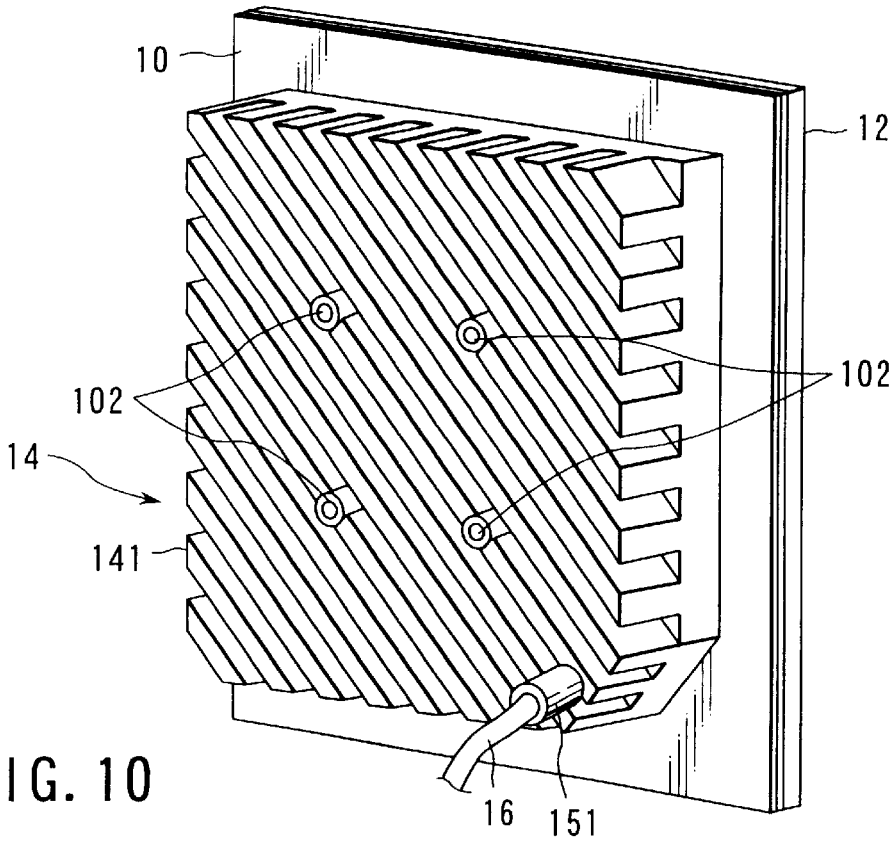
FIG. 10 is a perspective view showing configuration of arrangement of an external connector of an antenna apparatus according to yet another embodiment of the present invention.

Further, in the above-described embodiments, the case in which the external connector 15 is provided so as to protrude to make an acute angle with respect to the direction of gravity in both of the case of using the vertically polarized wave and the case of using the horizontally polarized wave has been described. However, the present invention is not limited to this case. For example, the external connector 151 may be disposed as shown in FIG. 10. In FIG. 10, for convenience, the same portions as those of FIGS. 1 through 6 are denoted by the same reference numerals, and descriptions thereof will be omitted.

In an embodiment shown in FIG. 10, the external connector 151 is provided at the rear surface of the case 10 so as to protrude substantially parallel to a direction that the radiating fins 141 are protruded. In this embodiment, as the above-described embodiments, stable connection to the external modulator/demodulator (not shown) can be realized in both of the case that the vertically polarized wave is governed by the case 10 and the case that horizontally polarized wave is governed by the case 10. Further, substantially same effect as those of the above-described embodiments can be expected.

The external connector 151 shown in FIG. 10 which is provided so as to protrude substantially parallel to the direction that the radiating fins 141 are protruded may be applied to the heat sink configurations including the heat sink 19 shown in FIGS. 7 and 8 and the heat sink 21 shown in FIG. 9. The same effect as those of heat sink configurations shown in FIGS. 7, 8 and 9 can be expected.

In the above-described embodiments, the case in which the present invention is applied to the antenna configuration that the antenna 11 is hermetically accommodated in the case 10 and the radome 12. However, the present invention is not limited to this antenna configuration, and other antenna configurations may be utilized. The same effect as those of the above-described embodiments can be expected.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An antenna apparatus comprising:

an antenna main body for transmitting or receiving a linearly polarized wave a case which houses said antenna body in accordance with a direction of polarization of a radio wave to be used; and a heat sink which is disposed at a surface of said case which serves as a radio emission/receiving surface of said antenna main body when said case is fixed, said heat sink including a row of radiating fins protruded in a direction where the radio wave is incident onto the surface of said case or emitted from the surface of said case, wherein the radiating fins of said heat sink e shaped such that upper ends of grooves between the radiation fins in a vertical direction are open, when the ease is fixed.

2. The antenna apparatus according to claim 1, wherein said heat sink is configured such that radiating fins are provided so as to form an acute angle with respect to the direction of gravity in any one of the direction of vertically polarized wave governed by said antenna main body and the direction of horizontally polarized wave governed by said antenna main body.

3. The antenna apparatus according to claim 2, wherein said antenna main body is provided with an external connector which is protruded so as to form an acute angle with respect to the direction of gravity in any one of the direction of said vertically polarized wave and the direction of said horizontally polarized wave.

4. The antenna apparatus according to claim 2, wherein said antenna main body is provided with the external connector which is protruded so as to be substantially parallel to The direction that said radiating fins of said heat sink are protruded.

5. The antenna apparatus according to claim 1, wherein said heat sink is configured such that said radiating fins are arranged in two direction which are substantially perpendicular to each other.

6. The antenna apparatus according to claim 5, wherein said antenna main body is provided with an external connector which is protruded so as to form an acute angle with respect to the direction of gravity in any one of the direction of said vertically polarized wave and the direction of said horizontally polarized wave.

7. The antenna apparatus according to claim 5, wherein said antenna main body is provided with the external connector which is protruded so as to be substantially parallel to the direction that said radiating fins of said heat sink are protruded.

8. The antenna apparatus according to claim 1, wherein said heat sink is configured such that said radiating fins are arranged substantially circularly.

9. The antenna apparatus according to claim 8, wherein said antenna main body is provided with an external connector which is protruded so as to form an acute angle with respect to the direction of gravity in any one of the direction of said vertically polarized wave and the direction of said horizontally polarized wave.

10. The antenna apparatus according to claim 8, wherein said antenna main body is provided with the external connector which is protruded so as to be substantially parallel to the direction that said radiating fins of said heat sink are protruded.

11. The antenna apparatus according to claim 1, wherein said antenna main body is provided with an external connector which is protruded so as to form an acute angle with respect to the direction of gravity in any one of the direction of said vertically polarized wave and the direction of said horizontally polarized wave.

12. The antenna apparatus according to claim 1, wherein said antenna main body is provided with the external connector which is protruded so as to be substantially parallel to a direction that said radiating fins of said heat sink are protruded.

13. An antenna apparatus comprising:

an antenna main body for transmitting or receiving a linearly polarized wave; and a heat sink which is disposed at a surface of said antenna main body which serves as a radio emission/receiving surface of said antenna main body when the antenna apparatus is fixed, said heat sink including a row of radiating fins protruded in a direction where a radio wave is incident onto the surface of said antenna main body or emitted from the surface of said antenna main body, wherein the radiating fins of said heat sink are shaped such that upper ends of grooves between the radiation fins in a vertical direction are open, when the antenna apparatus is fixed.

14. The antenna apparatus according to claim 13, wherein said heat sink is configured such that radiating fins are provided so as to form an acute angle with respect to the direction of gravity in any one of the direction of vertically polarized wave governed by said antenna main body and the direction of horizontally polarized wave governed by said antenna main body.

15. The antenna apparatus according to claim 14, wherein said antenna main body is provided with an external connector which is protruded so as to form an acute angle with respect to the direction of gravity in any one of the direction of said vertically polarized wave and the direction of said horizontally polarized wave.

16. The antenna apparatus according to claim 14, wherein said antenna main body is provided with the external connector which is protruded so as to be substantially parallel to the direction that said radiating fins of said heat sink are protruded.

17. The antenna apparatus according to claim 13, wherein said heat sink is configured such that said radiating fins are arranged in two direction which are substantially perpendicular to each other.

18. The antenna apparatus according to claim 17, wherein said antenna main body is provided with an external connector which is protruded so as to form an acute angle with respect to the direction of gravity in any one of the direction of said vertically polarized wave and the direction of said horizontally polarized wave.

19. The antenna apparatus according to claim 17, wherein said antenna main body is provided with the external connector which is protruded so as to be substantially parallel to the direction that said radiating fins of said heat sink are protruded.

20. The antenna apparatus according to claim 13, wherein said heat sink is configured such that said radiating fins are arranged substantially circularly.

21. The antenna apparatus according to claim 20, wherein said antenna main body is provided with an external connector which is protruded so as to form an acute angle with respect to the direction of gravity in any one of the direction of said vertically polarized wave and the direction of said horizontally polarized wave.

22. The antenna apparatus according to claim 20, wherein said antenna main body is provided with the external connector which is protruded so as to be substantially parallel to the direction that said radiating fins of said heat sink are protruded.

23. The antenna apparatus according to claim 13, wherein said antenna main body is provided with an external connector which is protruded so as to form an acute angle with respect to the direction of gravity in any one of the direction of said vertically polarized wave and the direction of said horizontally polarized wave.

24. The antenna apparatus according to claim 13, wherein said antenna main body is provided with the external connector which is protruded so as to be substantially parallel to a direction that said radiating fins of said heat sink are protruded.

* * * * *